United States Patent [19]

Adams

[11] 4,328,604

[45] May 11, 1982

[54] TOOTHBRUSHES

[76] Inventor: Gregory Adams, 708 11th St., Palacios, Tex. 77465

[21] Appl. No.: 185,225

[22] Filed: Sep. 8, 1980

[51] Int. Cl.[3] ..... A46B 9/04

[52] U.S. Cl. ..... 15/110; 15/106; 15/167 R; 15/DIG. 5; 128/62 A

[58] Field of Search ..... 15/110, 106, 167 R, 15/167 A, 167 B, DIG. 5; 128/62 A

[56] References Cited

U.S. PATENT DOCUMENTS

| | | | |
|---|---|---|---|
| 1,924,152 | 8/1933 | Coney et al. | 15/110 X |
| 1,993,662 | 3/1935 | Green | 15/110 |
| 2,042,239 | 5/1936 | Planding | 15/110 |
| 3,103,679 | 9/1963 | Clemens | 15/167 R |
| 4,053,959 | 10/1977 | Wiley | 15/110 X |

*Primary Examiner*—Peter Feldman

*Attorney, Agent, or Firm*—Larry Mason Lee

[57] ABSTRACT

A brush adapted for cleaning of the teeth, mouth, and gums of the user, comprising a toothbrush handle, ordinary toothbrush bristles affixed to one surface of a brush head at one end of said handle (hereinafter deemed the "brush end") in the usual and customary manner, and shorter, softer bristles, (hereinafter deemed "mouth bristles") for cleaning of the interior of the mouth and for massaging of the gums affixed to all surfaces of the above-mentioned brush head at the brush end of the toothbrush handle.

1 Claim, 2 Drawing Figures

TOOTHBRUSHES

BACKGROUND OF THE INVENTION

The instant Invention is directed to an improvement in toothbrushes, and is more particularly concerned with a novel form of multipurpose brush suitably adapted to provide means for massaging the gums, means for cleaning the interior or the mouth, in particular the inner surfaces of the cheeks, as well as means to accomplish the traditional teeth brushing functions of a toothbrush.

Proper oral hygiene clearly requires the routine cleaning of the entire mouth, including teeth, as well as the regular massaging of the gums and the cleansing of the interior, skin surfaces of the mouth. Neglecting to practice gum massage tends to promote unhealthy, disease-prone gums. Neglecting to practice regular cleansing of the interior, skin surfaces of the mouth allows the accumulation of filmy deposits and dead skin, thus promoting bad breath.

Individuals commonly neglect gum massage and cleansing of the interior, skin surfaces of the mouth because the use of a common toothbrush with its stiff bristles on the gums and skin surfaces of the mouth would be painful. A separate, softer brush could be used, as could a washrag, but utilization of either would require the insertion of additional paraphenalia and additional steps to the process of routine oral hygiene. The use of the instant invention accomplishes the desired massaging and cleansing without additional paraphenalia and without unduly lengthening the process of routine oral hygiene.

Numerous previous improvements on the basic toothbrush have been made ranging from gum massager attachments to brushes having bristles or appliances at each end of a toothbrush handle. However, no prior art relative to a brush having both tooth bristles and mouth bristles on the same end of the toothbrush handle is known to this inventor and therefore, no prior art is cited.

Accordingly, it is an object of this instant invention to provide a brush which is suitably adapted to provide means for massaging the gums, means for cleaning the interior of the mouth, and means to accomplish the traditional teeth brushing functions of a toothbrush.

Further, it is an object of this invention to provide a brush, suitable for use as a toothbrush, which facilitates the accomplishment of the oral hygiene steps of gum massage and cleansing of the interior, skin surfaces of the mouth by providing both ordinary toothbrush bristles and softer, shorter "mouth bristles" at the same end of the toothbrush handle.

DESCRIPTION OF THE INVENTION

Figure 1:
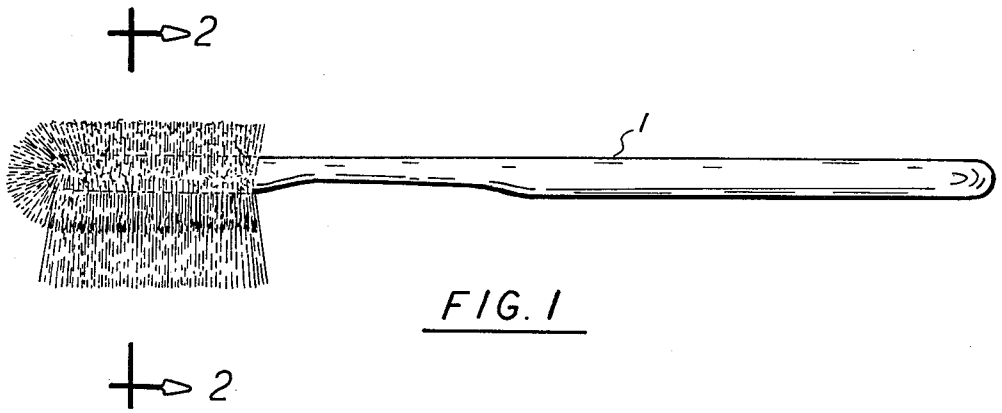
FIG. 1 is a lateral elevational view of the invention.
Figure 2:
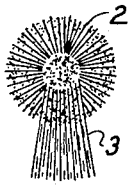
FIG. 2 is a front elevational view of the invention as depicted in FIG. 1.

The invention is of a tooth and mouth brush comprising a toothbrush handle 1, toothbrush bristles 3, and mouth bristles 2.

No particular importance is attached to the dimensions or geometry of the toothbrush handle 1, except that the following description assumes that said toothbrush handle 1 will in all instances have a length, such that a long axis will exist.

Toothbrush bristles 3 are assumed in this invention to be of usual and customary design and construction. It is expected that said bristles will be attached to one surface of a brush head disposed on the toothbrush handle 1 in a region near one end of said handle's length. It is expected also that the toothbrush bristles 3 will have the usual characteristics of stiffness, flexibility, and length found in present commercially available toothbrushes. Typically, also, such toothbrush bristles 3 will be embedded or attached to the brush head on toothbrush handle 1 in an approximately parallel fashion perpendicular to the long axis of the toothbrush handle 1.

The unique aspect of this invention consists of the addition of mouth bristles 2 to the ordinary toothbrush. Said mouth bristles 2 should be shorter and more flexible than the usual toothbrush bristles 3 and said mouth bristles 2 should be attached to and/or protrude from all exposed surfaces of the brush head or the toothbrush handle 1 beginning at that end of the toothbrush handle 1 which has the toothbrush bristles 3 attached and ending at some point along the length of the toothbrush handle 1 which coincides roughly with the point at which the toothbrush bristles 3 are no longer embedded or attached to the toothbrush handle 1.

The methods of manufacture and the composition of the bristles mentioned herein are myriad and non-essential to this invention as is the method of attachment of the bristles to the toothbrush handle 1.

Wherefore, I claim:

1. A brush for use in brushing of teeth, mouth, and gums comprising:

an elongated handle having a brush head disposed on one end of said handle with two sets of bristles protruding from said brush head;

said first set of bristles being of a length and stiffness suitable for brushing of teeth;

said first set of bristles being attached to or protruding from one surface of the brush head;

said second set of bristles being shorter and softer than said first set of bristles;

and said second set of bristles being attached to or protruding from all surfaces of the brush head.

* * * * *